US009540158B1

(12) United States Patent
Fox

(10) Patent No.: US 9,540,158 B1
(45) Date of Patent: Jan. 10, 2017

(54) LOWER SHIPPING SUPPORT FOR AN APPLIANCE SUCH AS A WASHING MACHINE

(71) Applicant: Green Bay Packaging, Inc., Green Bay, WI (US)

(72) Inventor: Brian W. Fox, Tiffin, OH (US)

(73) Assignee: Green Bay Packaging, Inc., Green Bay, WA (US)

( * ) Notice: Subject to any disclaimer, the term of this patent is extended or adjusted under 35 U.S.C. 154(b) by 117 days.

(21) Appl. No.: 14/283,597

(22) Filed: May 21, 2014

Related U.S. Application Data

(60) Provisional application No. 61/826,678, filed on May 23, 2013.

(51) Int. Cl.
*B65D 19/00* (2006.01)
*B65D 67/00* (2006.01)
*D06F 39/00* (2006.01)

(52) U.S. Cl.
CPC ..... *B65D 67/00* (2013.01); *D06F 39/001* (2013.01); *B65D 2581/02* (2013.01)

(58) Field of Classification Search
CPC ..... D06F 39/001; B65D 5/5035; B65D 5/504
USPC .... 248/678, 680, 677, 346.01, 346.3, 188.1, 248/188.6; 206/320; 229/113, 117.01; 108/53.1
See application file for complete search history.

(56) References Cited

U.S. PATENT DOCUMENTS 4,754,914 A * 7/1988 Wischusen, III .... A47G 21/001 229/87.08
7,014,160 B2 * 3/2006 Muyskens ..... B65D 5/5035 206/320
8,074,952 B2 * 12/2011 Baechle ..... D06F 39/001 108/51.3
8,317,150 B2 * 11/2012 Baechle ..... D06F 39/001 108/53.1
2006/0065561 A1 * 3/2006 Marventano ..... B65B 67/08 206/320
2011/0240498 A1 10/2011 Trebilcock et al.
2014/0151521 A1 6/2014 Marrow

* cited by examiner

*Primary Examiner* — Todd M Epps
(74) *Attorney, Agent, or Firm* — Boyle Fredrickson, S.C.

(57) ABSTRACT

A base for supporting a component of an appliance and a method of assembling the same, is formed from a single sheet having four opposing sides and a top of the base when erected. Two of the opposing sides include inner and outer panels that are affixed to one another to maintain the base in the erected configuration, and define an internal cavity therein for receiving the appliance component. When a force is applied to the appliance, the erected base supports the component, which may be the motor of a washing machine, within the internal cavity to inhibit movement of the component.

17 Claims, 9 Drawing Sheets

LOWER SHIPPING SUPPORT FOR AN APPLIANCE SUCH AS A WASHING MACHINE

CROSS-REFERENCE TO RELATED APPLICATION

This application claims the benefit of U.S. Ser. No. 61/826,678 filed May 23, 2013, the disclosure of which is incorporated herein in its entirety.

FIELD OF THE INVENTION

The present invention relates to a lower shipping support for an appliance such as a washing machine and, more particularly a one-piece lower support for supporting internal components of a washing machine to inhibit movement of the components during transportation and storage.

BACKGROUND OF THE INVENTION

Conventional top-loading washing machines include a cylindrical tub that is located within an exterior housing. The motor which provides rotational movement for the tub is suspended within the housing, and is positioned below or underneath the tub and elevated above the surface on which the washing machine rests. This configuration is advantageous in that it allows for the motor to drive both the motion of a central agitator and a perforated basket, both of which are located within the cylindrical tub. However, the suspended motor configuration exposes the motor to the potential for impact damage from either contact with the tub or housing during shipment of the washing machine.

Providing a lower support that extends upwards into the washing machine housing and inhibits movement of the motor during shipment and storage of the washing machine decreases this potential for impact damage to the motor. However, such lower supports or shipping bases are often formed of multiple pieces or blanks of corrugated board that are folded and/or adhesively retained in the desired shape. This multiple piece construction is time consuming, expensive to manufacture, and introduces increased potential for inaccurate assembly. In the context of large scale manufacturing and shipment of washing machines, the additional steps required to combine multiple pieces to construct a lower support or shipping base constitutes a significant overhead cost and investment of time.

The present invention solves the aforementioned drawbacks by providing a lower support that is formed from a single piece or blank of packaging material, which can easily and accurately be assembled into the desired lower support shape by means of folding and adhesive bonding. The present invention provides a lower support that is particularly well suited for use in shipping washing machines, but may also be beneficial for other shipping and distribution needs, including the shipment of appliances that require internal component support.

SUMMARY OF THE INVENTION

The present invention provides a base or lower support for receiving and supporting an appliance or a component of an appliance, formed of a single blank or sheet. The sheet includes a first side and an opposing second side, each of which have an outer panel and an inner panel that are configured to be affixed in an overlapping position to maintain the base in an erected configuration. The sheet also includes third and forth sides located between the opposing first and second sides, a top panel extending between two opposing sides of the base and a discontinuous flange about the bottom of the base. The erected base includes a cavity defined by the four sides, which is configured to receive and support a component of the appliance therein, such as a washing machine motor. This inhibits the motor from undesirably moving during shipment and storage of the washing machine.

The present invention further provides a plurality of supporting blocks located on the upwardly facing surfaces of the flange. The supporting blocks are configured to receive and support the appliance thereon when the component is received within the cavity.

The present invention further provides an irregular or nonlinear edge around the upper surface of the internal cavity of the base, which is contoured to engage the underside of the washing machine or the washing machine motor and further inhibit movement of the motor.

The present invention further provides a selectively disengagable top panel, configured to further engage the lower surface of the washing machine motor to further inhibit movement of the motor.

The present invention further provides a method of assembling a blank or sheet comprising four sides, a top panel, and a discontinuous flange into the erected base. The method includes the steps of folding the sheet's four sides into an erected configuration, affixing the outer panels of two opposing sides to their corresponding inner panels, while overlapping; and extending a discontinuous flange outwardly from a lower edge of the base. A component of an appliance, such as a washing machine, can then be inserted into an internal cavity defined by the four sides.

Various other features, objects and advantages of the present invention will be made apparent from the following detailed description of the drawing figures.

BRIEF DESCRIPTION OF THE DRAWINGS

The drawings illustrate a representative embodiment presently contemplated for carrying out the present invention. It should be understood that the invention is not limited to the embodiments disclosed, and is capable of variations within the scope of the appended claims.

In the drawings.

DETAILED DESCRIPTION

I. Embodiment One

Referring initially to FIGS. 1-4, there is shown a base or lower support 10 according to a first embodiment of the present invention. The lower support 10 generally is made of a sheet or blank 12 of packaging material. The packaging material may consist of corrugated board, cardboard, plastic or any similar material suitable for use in shipping container construction. Representatively, the corrugated board may consist of a fluted corrugated core located between two sheets of kraft paper or linerboard, in a manner as is known. The blank 12 may be stamped or cut from a sheet of the packaging material while in a substantially flat orientation, and subsequently folded to form the lower support 10. The outer surface of the lower support 10 may be printed to display information such as contents details, shipping information, disassembly instructions, orientation indicia and the like. The outer surface of the lower support 10 may also contain advertising information or ornamental elements.

Figure 1:
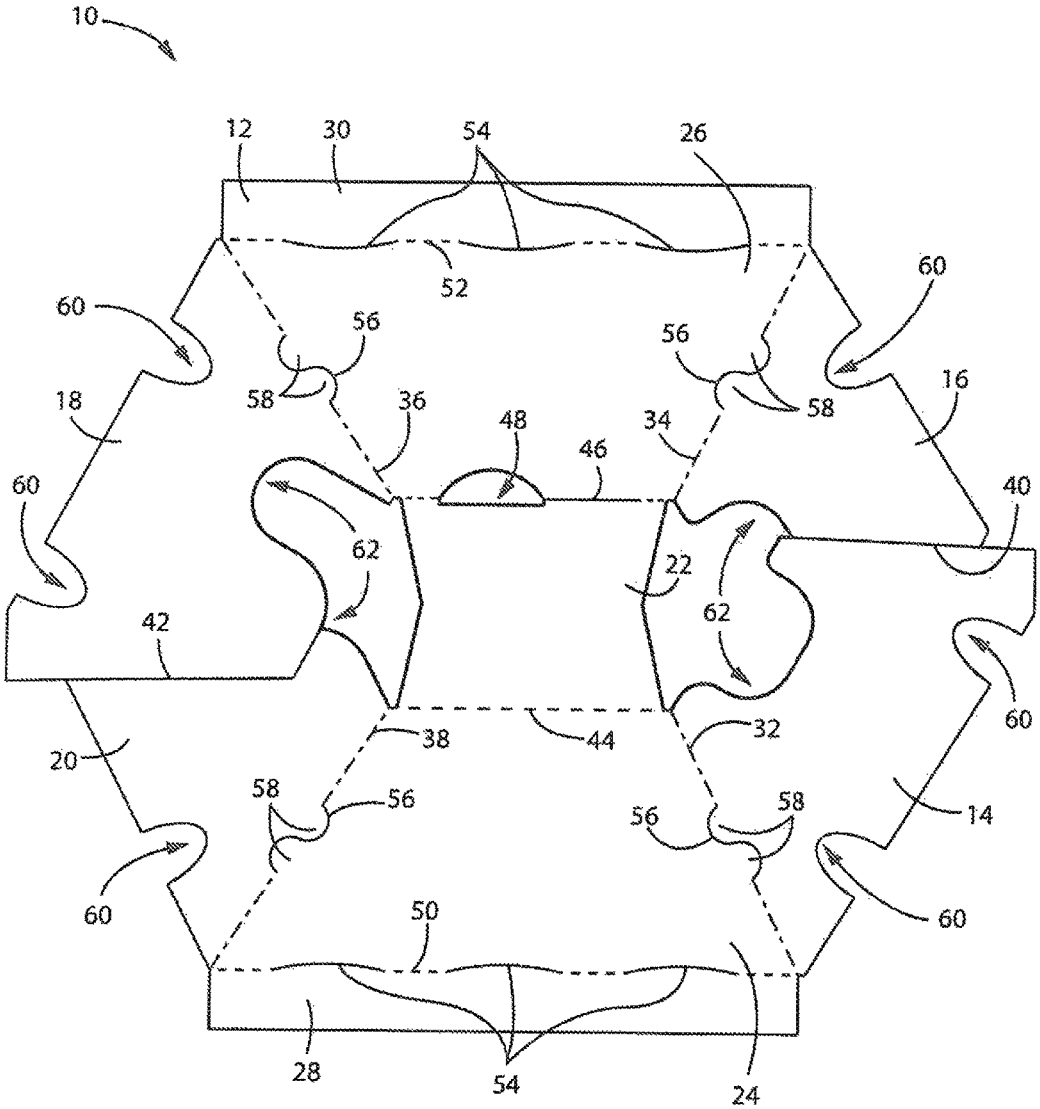
FIG. 1 is a top plan view of an unfolded blank or sheet of a lower support for an appliance such as a washing machine, according to one aspect of the present invention.

FIG. 1 illustrates the blank 12, formed of a single piece of packaging material in a flat orientation. The blank 12 includes primarily an outer front panel 14, an inner front panel 16, an outer rear panel 18, an inner rear panel 20, a top panel 22, a first side panel 24, a second side panel 26, a first side flange 28, and a second side flange 30. As illustrated in FIG. 1, the blank 12, when in a flat orientation roughly approximates an irregular hexagonal shape with the front, rear and side panels 14, 16, 18, 20, 24, 26 roughly approximating irregular trapezoids.

The outer front panel 14 is hingedly attached to the first side panel 24 about a score line 32, while the inner front panel 16 is hingedly attached to the second side panel 26 about a score line 34. Similarly, on the opposing side of the blank 12, the outer rear panel 18 is hingedly attached to second side panel 26 at a score line 36, while the inner rear panel 20 is hingedly attached to the first side panel 24 at a score line 38. The score lines 32 and 38 are located on opposing ends of the first side panel 24, and the score lines 34 and 36 are located on opposing ends of the second side panel 26.

The outer front panel 14 is located adjacent the inner front panel 16, and separated therefrom by a cut line 40. On the opposing end of the blank 12, the outer rear panel 18 is also located adjacent the inner rear panel 20, and separated therefrom by a cut line 42. In this orientation the front panels 14, 16 are free to rotate about their score lines 32, 34, respectively, while the rear panels 18, 20 are free to rotate about their respective score lines 36, 38.

Still referring to FIG. 1, the top panel 22 is located between the first and second side panels 24, 26. Top panel 22 is hingedly affixed to the first side panel 24 at a score line 44. Score line 44 extends between the score lines 32 and 38, and is configured to be located on the upper edge of the lower support 10, when the lower support 10 is erected in a folded configuration. The opposing side of the top panel 22 is attached to the second side panel 26 at a perforated line 46. Perforated line 46 extends between the score lines 34 and 36, and is also configured to be located on the upper edge of the lower support 10, when the lower support 10 is erected. As illustrated in FIG. 1, a void 48 may interrupt the perforated line 46, and partially extend into both the top panel 22 and the second side panel 26.

As illustrated in FIG. 1, first and second side flanges 28, 30 are affixed to the first and second side panels 24, 26, respectively, along the edges opposite the top panel 22. That is to say that the first side flange 28 is hingedly affixed to the first side panel 24 at a score line 50, which is configured to be located on the lower edge of the lower support 10, when the lower support 10 is erected. Similarly, the second side flange 30 is hingedly affixed to the second side panel 26 at a score line 52, which is also configured to be located on the lower edge of the lower support 10, when the lower support 10 is erected. In one embodiment, as illustrated in FIG. 1, the score lines 50, 52 may be interrupted by one or more perforation or cut lines 54 through the blank 12 of packaging material. These cut lines 54 may be linear or arched into the area of the side panels 24, 26, as shown, and may provide increased flange surface area for supporting the washing machine and/or structural reinforcement to the side panels 24, 26.

Similarly, the score lines 32, 34, 36, 38, that separate the side panels 24, 26 from the front and rear panels 14, 16, 18, 20 respectively may also be interrupted by one or more perforation or cut lines 56. As illustrated in FIG. 1, the cut lines 56 may have a curve, such as a sigmoidal or S-shaped curve that extends beyond the respective score line 32, 34, 36, 38, and into the surrounding panel 14, 16, 18, 20, 24, 26. Accordingly, when the lower support 10 is erected in a folded configuration and the panels 14, 16, 18, 20, 24, 26 are folded about their respective score lines 32, 34, 36, 38, the cut lines 56 will result in the formation of one or more outwardly projecting tabs 58. In the illustrated embodiment, the two outwardly projecting tabs 58 of each score line 32, 34, 36, 38, engage one another when the lower support 10 is erected to provide structural reinforcement. However, other shapes of the cut lines 56 and tabs 58 are considered well within the scope of the invention.

Additionally, the front and rear panels 14, 16, 18, 20 may include one or more voids as is illustrated in FIG. 1. Specifically, the panels 14, 16, 18, 20 may include one or more lower voids 60 and/or one or more upper voids 62. As illustrated in FIG. 1, the outer front and rear panels 14, 18 may each include two lower voids 60, while the inner front and rear panels 16, 20 may each include one lower void 60. When the lower support 10 is erected, the one lower void 60 of the inner front and rear panels 16, 20 will overlap or correspond with the one lower void 60 on the respective outer front and rear panels 14, 18 that is located nearest the cut line 40, 42. These lower voids 60 may provide structural reinforcement to the panels 14, 16, 18, 20, allow the lower support 10 to integrate with the remaining portions of the shipping container, allow the lower support 10 to engage other shipping containers when stacked, and/or allow the lower support to be maneuvered by either a person or a mechanical lift.

Furthermore, as illustrated in FIG. 1, the upper voids 62 are located along the upper edges of the front and rear panels 14, 16, 18, 20. The upper voids 62 are configured to accommodate and engage the motor or other components of the washing machine, once the lower support 10 has been erected. Accordingly, the number, shape and orientation of the upper voids 62 may vary depending on the configuration of the motor or other components of the washing machine or appliance. As specifically illustrated in FIG. 1, the upper void 62 of outer front panel 14 is approximately centrally located along the upper edge of the outer front panel 14, and extends downwardly therefrom. The upper void 62 of the inner front panel 16 extends across a portion of the upper edge of the inner front panel 16, and is configured to overlap or correspond with the upper void 62 of outer front panel 14, when the lower support 10 is erected. Alternatively, the upper void 62 of the outer rear panel 18 may be offset along the upper edge of the outer rear panel 18, such that it is disposed adjacent the score line 36. The corresponding upper void 62 of the inner rear panel 20 is therefore reduced to a curved corner near cut line 42 along a portion of the upper edge of the inner rear panel 20, which is configured to overlap with the upper void 62 of outer rear panel 18, when the lower support 10 is erected.

Figure 2A:
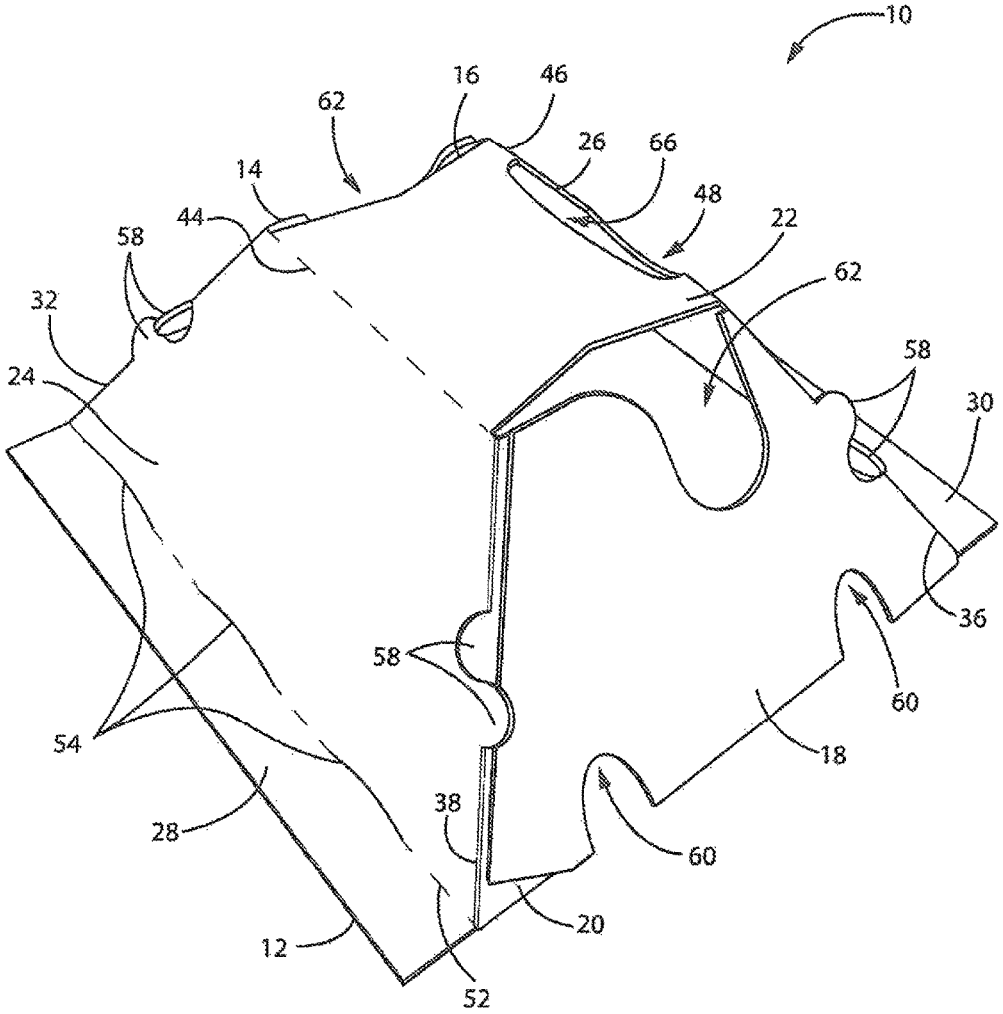
FIG. 2A is a perspective view of the folded lower support of FIG. 1 showing the lower support in an erected configuration.
Figure 2B:
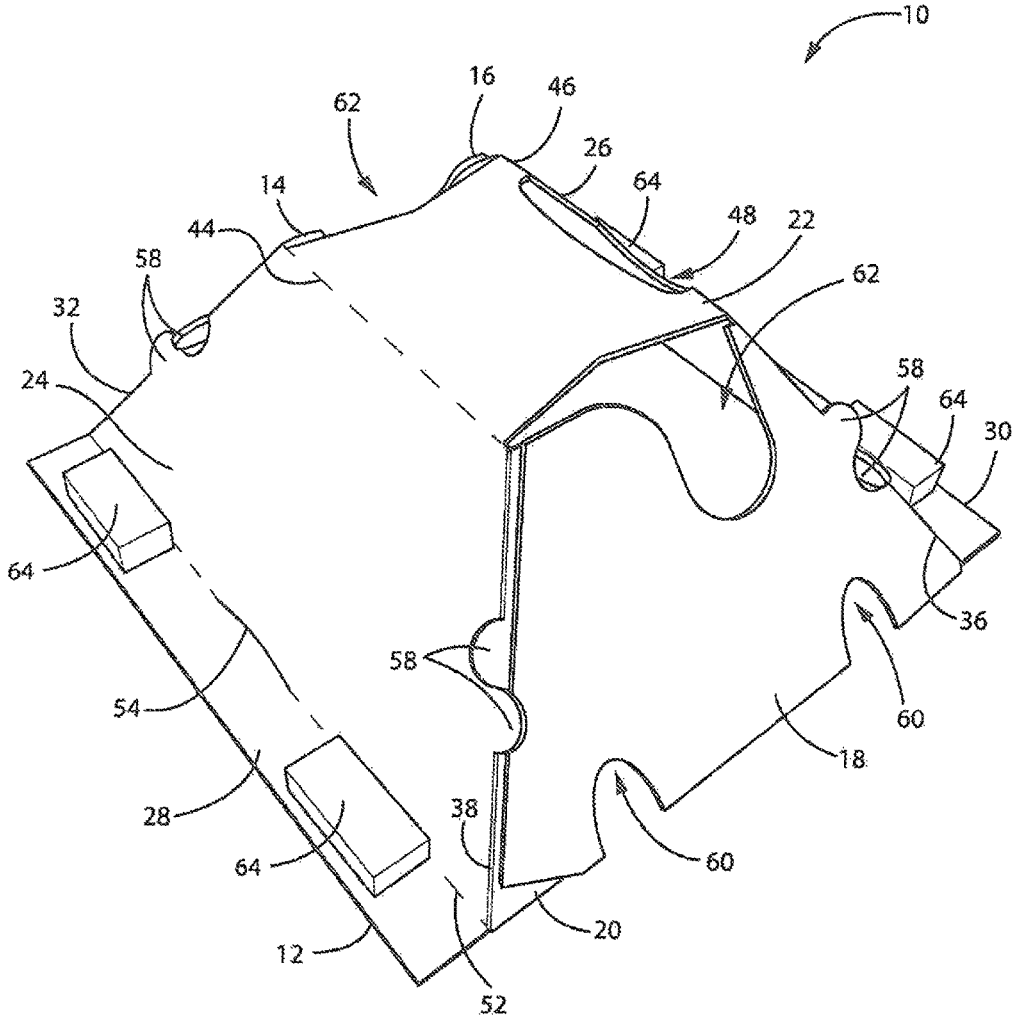
FIG. 2B is a perspective view similar to FIG. 2A, showing the lower support in an erected configuration including a plurality support blocks on lower flanges.

Turning now to FIG. 2A, the blank 12 will be described in a folded and erected configuration to form lower support 10. The blank 12 is folded approximately 90 degrees around the score lines 32, 34, 36, 38 until the inner and outer front panels 14, 16 and inner and outer rear panels 18, 20 overlap such that their respective upper and lower voids 60, 62 also overlap. The blank 12 is then retained in this folded configuration by means of applying adhesive between the inner and outer front panels 14, 16 and inner and outer rear panels 18, 20. Alternatively, the front panels 14, 16 and rear panels 18, 20 may be retained in their folded configuration by means of fasteners, adhesive tape or any other known means of fixation. The side flanges 28, 30 are then folded outwardly around score lines 50, 52 respectively to form a base of support on which the lower support 10 rests. Once the side flanges 28, 30 have been folded, support blocks 64 may be placed on or fixed to the upper surface of the side flanges 28, 30, as illustrated in FIG. 2B. The support blocks 64 are configured to receive the housing of the washing machine or other appliance, either directly or indirectly thereon, and may be formed of a resilient or shock absorbent material such as foam. The upper surface of the blocks 64 may be flat as illustrated in FIG. 2B, or they may be contoured to engage a portion of the washing machine or its housing therein.

Figure 3:
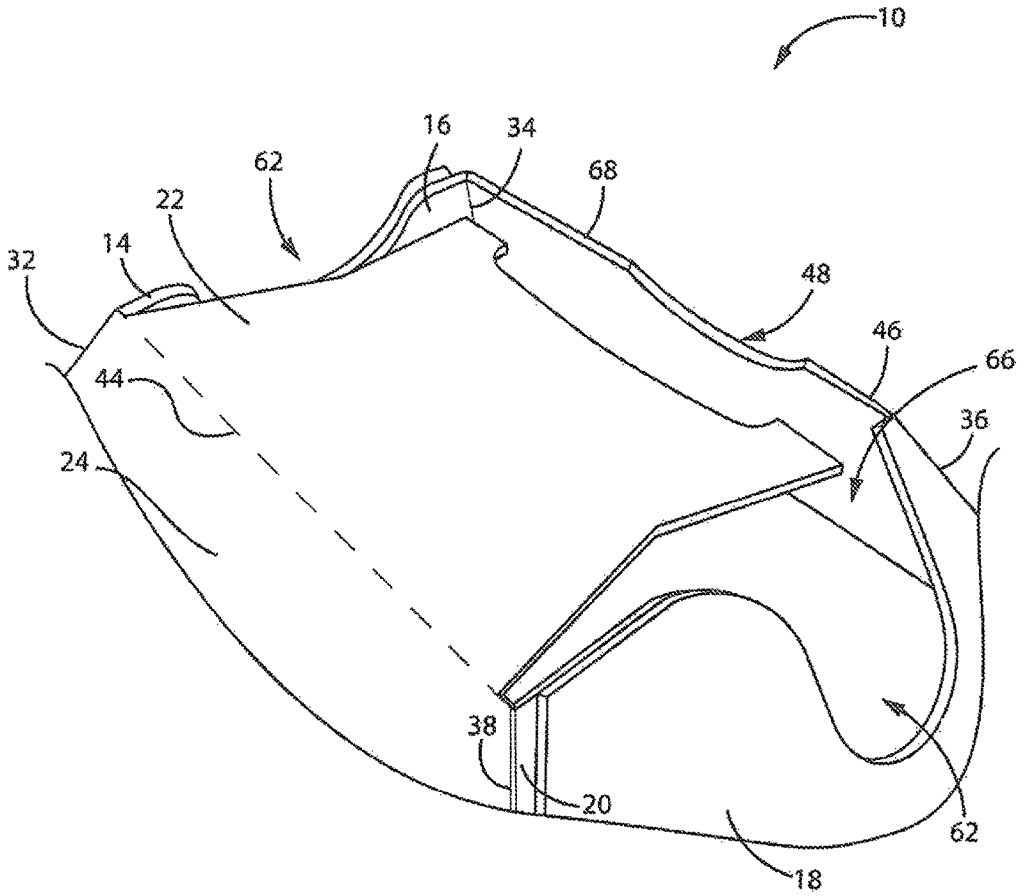
FIG. 3 is a partial enlarged perspective view of the folded lower support of FIG. 1 showing the upper portion of the lower support in an erected configuration including the top panel disengaged from the side panel.
Figure 4:
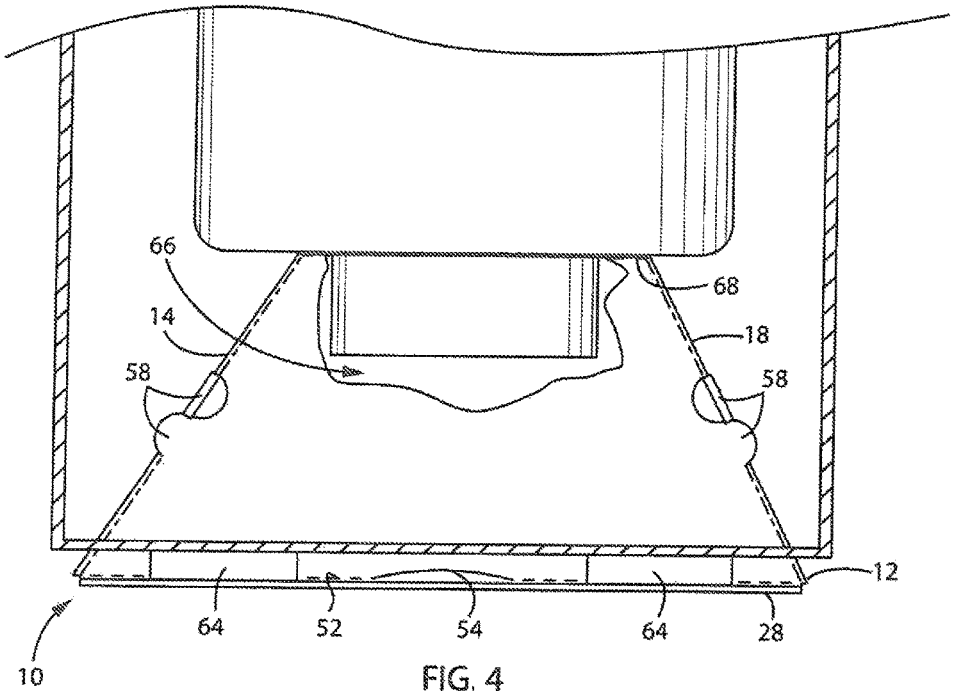
FIG. 4 is a partial cross sectional side view of the folded lower support of FIG. 2B showing the lower support in an erected configuration supporting an appliance such as a washing machine, and an internal component of the washing machine, thereon.

Turning now to FIG. 3, once the lower support 10 has been retained in its folded configuration described above, the top panel 22 may be disengaged from the second side panel 26 to form an access to an interior cavity 66. The top panel 22 may be disengaged from the second side panel by rupturing the perforated line 46. Rupturing the perforated line 46 may be accomplished by grasping the top panel 22 through void 48 and pushing or pulling thereon, or alternatively placing the washing machine on top of the lower support 10 and allowing the weight of the machine or its internal component to rupture the perforated line 46. Once the perforated line 46 has been ruptured, the top panel 22 will rotate about the score line 44 into the interior cavity 66. The interior cavity 66 will have an irregular upper edge 68, defined in part by score line 44 on the first side panel, perforated line 46 on the second side panel, and the upper voids 62 on the front and rear panels 14, 16, 18, 20. In this folded or erected configuration, the weight of the washing machine or other applicance is supported by the side flanges 28, 30 and the motor or other internal components of the washing machine will be retained within the interior cavity 66 and rest along the irregular upper edge 68, as shown in FIG. 4. In this manner, the base or lower support 10 is itself clamped between the appliance and the lower wall of the outer carton within, which the appliance is placed, and the truncated pyramid shape defined by the panels 14, 18, 24 and 26 extends upwardly into engagement with the bottom of the appliance component, such as the washing machine tub, while suspending an appliance component therebelow, such as a motor, within its interior thereby inhibiting movement of these components and preventing impact damage during shipment.

II. Embodiment Two

Figure 5:
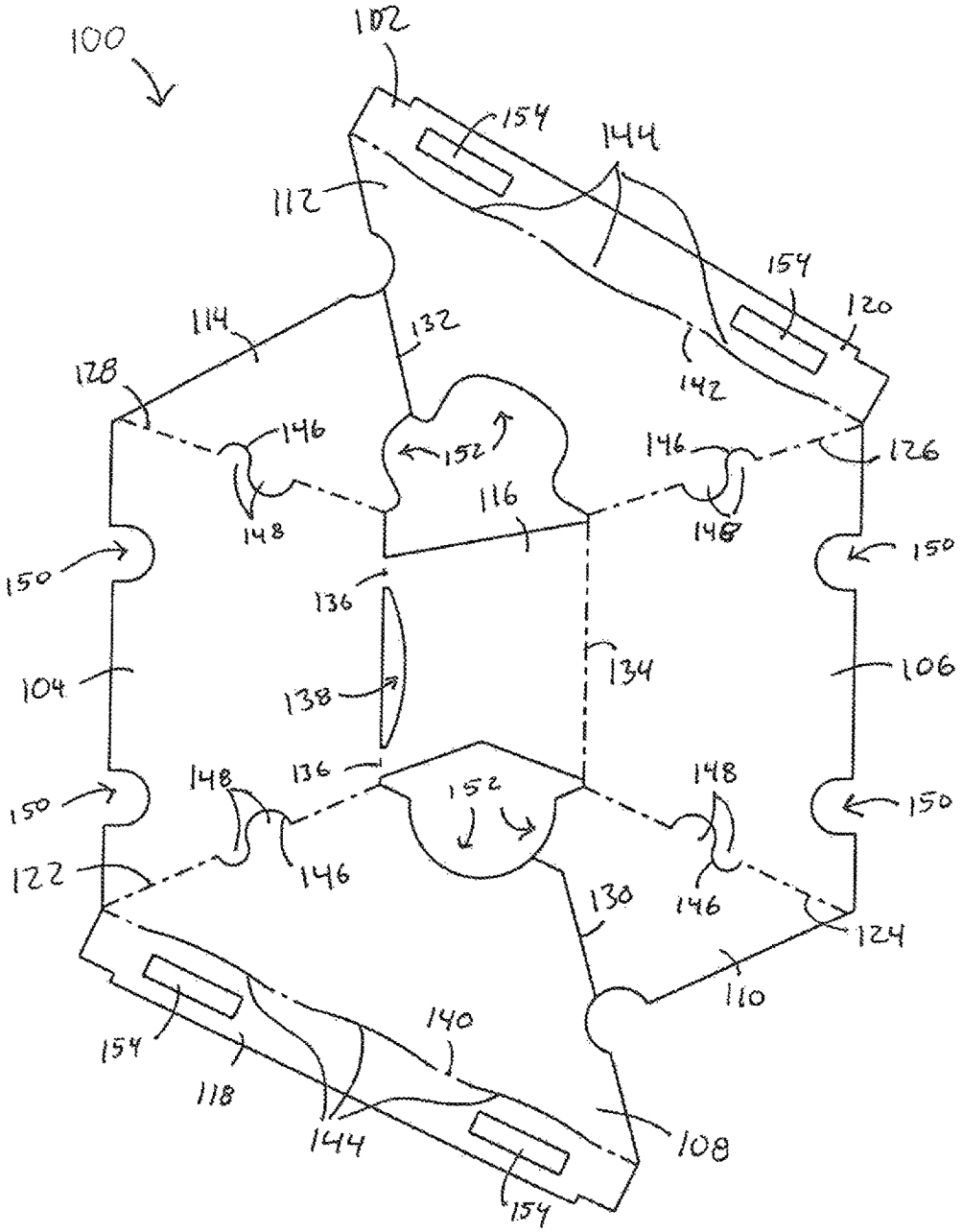
FIG. 5 is a top plan view of an unfolded blank or sheet of a lower support for an appliance such as a washing machine, according to a first alternative embodiment of the present invention.
Figure 6:
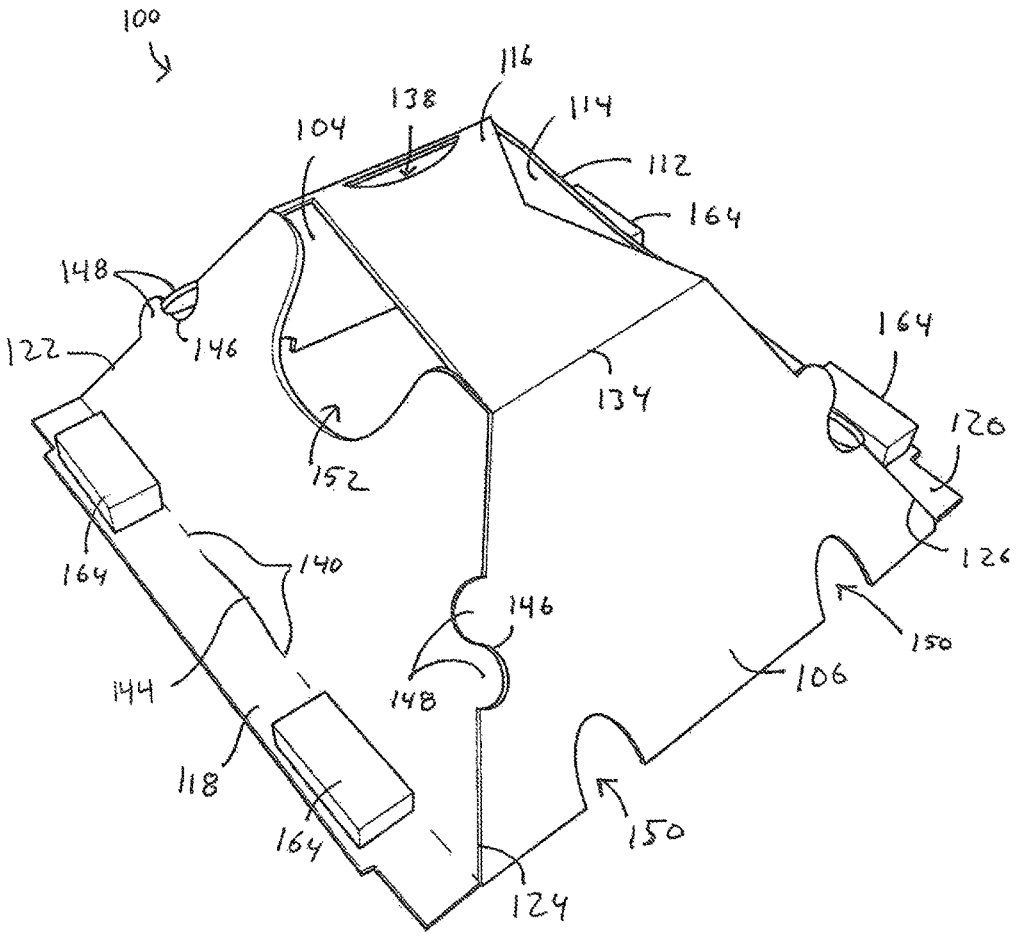
FIG. 6 is a perspective view of the folded lower support of FIG. 5 showing the lower support in an erected configuration.

Turning now to FIGS. 5 and 6 and initially FIG. 5, there is shown a base or lower support 100 according to a first alternative embodiment the present invention. The lower support 100 generally is made of a sheet or blank 102 of packaging material. As with the prior embodiment, the packaging material may consist of corrugated board having a fluted corrugated core located between two sheets of kraft paper or linerboard, cardboard, or any similar material suitable for use in shipping container construction. The blank 102 may be stamped or cut from a sheet of the packaging material while in a substantially flat orientation, and subsequently folded to form the erected lower support 100 illustrated in FIG. 6. The outer surface of the lower support 100 may be printed to display information such as contents details, shipping information, disassembly instructions, orientation indicia and the like. The outer surface of the lower support 100 may also contain advertising information or ornamental elements.

FIG. 5 illustrates the blank 102, formed of a single piece of packaging material in a flat orientation. The blank 102 includes primarily a front panel 104, a rear panel 106, an outer first side panel 108, an inner first side panel 110, an outer second side panel 112, an inner second side panel 114, a top 116, a first side flange 118, and a second side flange 120. As illustrated in FIG. 5, the blank 102, when in a flat orientation roughly approximates an irregular hexagonal shape with the front, rear and side panels 104, 106, 108, 110, 112, 114, 116 roughly approximating irregular trapezoids.

The front panel 104 is hingedly attached to the outer first side panel 108 about a score line 122, while the inner first side panel 110 is hingedly attached to the rear panel 106 about a score line 124. Similarly, on the opposing side of the blank 102, the rear panel 106 is hingedly attached to the outer second side panel 112 at a score line 126, while the inner second side panel 114 is hingedly attached to the front panel 106 at a score line 128. The score lines 122 and 128 are located on opposing ends of the front panel 104, and the score lines 124 and 126 are located on opposing ends of the rear panel 106.

The outer first side panel 108 is located adjacent the inner first side panel 110, and separated therefrom by cut line 130. On the opposing end of the blank 102, the outer second side panel 112 is also located adjacent the inner second side panel 114, and separated therefrom by cut line 132. In this orientation the first side panels 108, 110 are free to rotate about their score lines 122, 124, respectively, while the second side panels 112, 114 are free to rotate about their respective score lines 126, 128.

Still referring to FIG. 5, the top panel 116 is located between the front and rear panels 104, 106. Top panel 116 is hingedly affixed to the rear panel 106 at a score line 134. Score line 134 extends between the score lines 124 and 136, and is configured to be located on the upper edge of the lower support 100, when the lower support 100 is erected in a folded configuration. The opposing side of the top panel 116 is attached to the front panel 104 at a perforated line 136. Perforated line 136 extends between the score lines 122 and 128, and is also configured to be located on the upper edge of the lower support 100, when the lower support 100 is erected. As illustrated in FIG. 5, a void 138 may interrupt the perforated line 136, and partially extend into the top panel 116.

As illustrated in FIG. 5, first and second side flanges 118, 120 are affixed to the outer first and second side panels 108, 112, respectively, along the edges opposite the top panel 116. That is to say that the first side flange 118 is hingedly affixed to the outer first side panel 108 at a score line 140, which is configured to be located on the lower edge of the lower support 100, when the lower support 100 is erected. Similarly, the second side flange 120 is hingedly affixed to the outer second side panel 112 at a score line 142, which is also configured to be located on the lower edge of the lower support 100, when the lower support 100 is erected. In one embodiment, as illustrated in FIG. 5, the score lines 140, 142 may be interrupted by one or more perforation or cut lines 144 through the blank 102 of packaging material. These cut lines 144 may be linear or arched into the area of the outer first and second side panels 108, 112, as shown, and may provide increased flange surface area for supporting the washing machine and/or structural reinforcement to the outer first and second side panels 108, 112.

Similarly, the score lines 122, 124, 126, 128, that separate the side panels 108, 110, 112, 114 from the front and rear panels 104, 106 respectively may also be interrupted by one or more perforation or cut lines 146. As illustrated in FIG. 5, the cut lines 146 may have a curve, such as a sigmoidal or S-shaped curve that extends beyond the respective score line 122, 124, 126, 128, and into the surrounding panel 104, 106, 108, 110, 112, 114. Accordingly, when the lower support 100 is erected in a folded configuration and the panels 104, 106, 108, 110, 112, 114 are folded about their respective score lines 122, 124, 126, 128, the cut lines 146 will result in the formation of one or more outwardly projecting tabs 148. In the illustrated embodiment, the two outwardly projecting tabs 148 of each score line 122, 124, 126, 128, engage one another when the lower support 100 is erected to provide structural reinforcement. However, other shapes of the cut lines 146 and tabs 148 are considered well within the scope of the invention.

Additionally, the front and rear panels 104, 106 may include one or more voids as are illustrated in FIG. 5. Specifically, the panels 104, 106 may include one or more lower voids 150 and/or one or more upper voids 152. These lower voids 150 may provide structural reinforcement to the panels 104, 106, allowing the lower support 100 to integrate with the remaining portions of the shipping container, allow the lower support 100 to engage other shipping containers when stacked, and/or allow the lower support to be maneuvered by either a person or a mechanical lift.

Furthermore, as illustrated in FIG. 5, the upper voids 152 are located along the upper edges of the inner and outer first and second side panels 108, 110, 112, 114. The upper voids 152 are configured to accommodate and engage the motor or other components of the washing machine, once the lower support 100 has been erected. Accordingly, the number, shape and orientation of the upper voids 152 may vary depending on the configuration of the motor or other components of the washing machine or appliance. As specifically illustrated in FIG. 5, the outer first and second panels 108, 112 may each include one upper void 152, while the inner first and second side panels 110, 114 may also include one upper void 152. The upper void 152 of the outer first side panel 108 extends across a portion of the upper edge of the outer first side panel 108, while alternatively, the upper void 152 of the inner first side panel 110 may be offset along the upper edge of the inner first side panel 110, such that it is disposed adjacent the cut line 130. The corresponding upper void 152 of the inner first side panel 112 is therefore reduced to a curved corner near cut line 130 along a portion of the upper edge of the inner first side panel 110. Similarly, The upper void 152 of the outer second side panel 112 extends across a portion of the upper edge of the outer second side panel 112, while alternatively, the upper void 152 of the inner second side panel 114 may be offset along the upper edge of the inner second side panel 112, such that it is disposed adjacent the cut line 132. The corresponding upper void 152 of the inner second side panel 114 is therefore reduced to a curved corner near cut line 132 along a portion of the upper edge of the inner first side panel 110.

Turning now to FIG. 6, the blank 102 will be described in a folded and erected configuration to form lower support 100. The blank 102 is folded approximately 90 degrees around the score lines 122, 124, 126, 128, until the inner and outer first side panels 108, 1110 and inner and outer second side panels 112, 114 overlap such that their respective upper voids 152 also overlap. The blank 102 is then retained in this folded configuration by means of applying adhesive between the inner and outer first side panels 108, 110 and inner and outer second side panels 112, 124. Alternatively, the firs side panels 108, 110 and second side panels 112, 114 may be retained in their folded configuration by means of fasteners, adhesive tape or any other known means of fixation. The side flanges 118, 120 are then folded outwardly around score lines 140, 142, respectively to form a base of support on which the lower support 100 rests. Once the side flanges 118, 120 have been folded, support blocks 154 may be placed or fixed to the upper surface of the side flanges, as illustrated in FIGS. 5 and 6. The support blocks 154 are configured to receive the housing of the washing machine or other appliance, either directly or indirectly thereon, and may be formed of a resilient or shock absorbent material such as foam. The upper surface of the blocks 154 may be flat as illustrated in FIG. 6, or they may be contoured to engage a portion of the washing machine therein.

The top panel 116 may then be disengaged and the lower support 100 positioned to support the internal component(s) of an appliance such as a washing machine in the same manner as shown in FIG. 4 and described previously.

III. Embodiment Three

Figure 7:
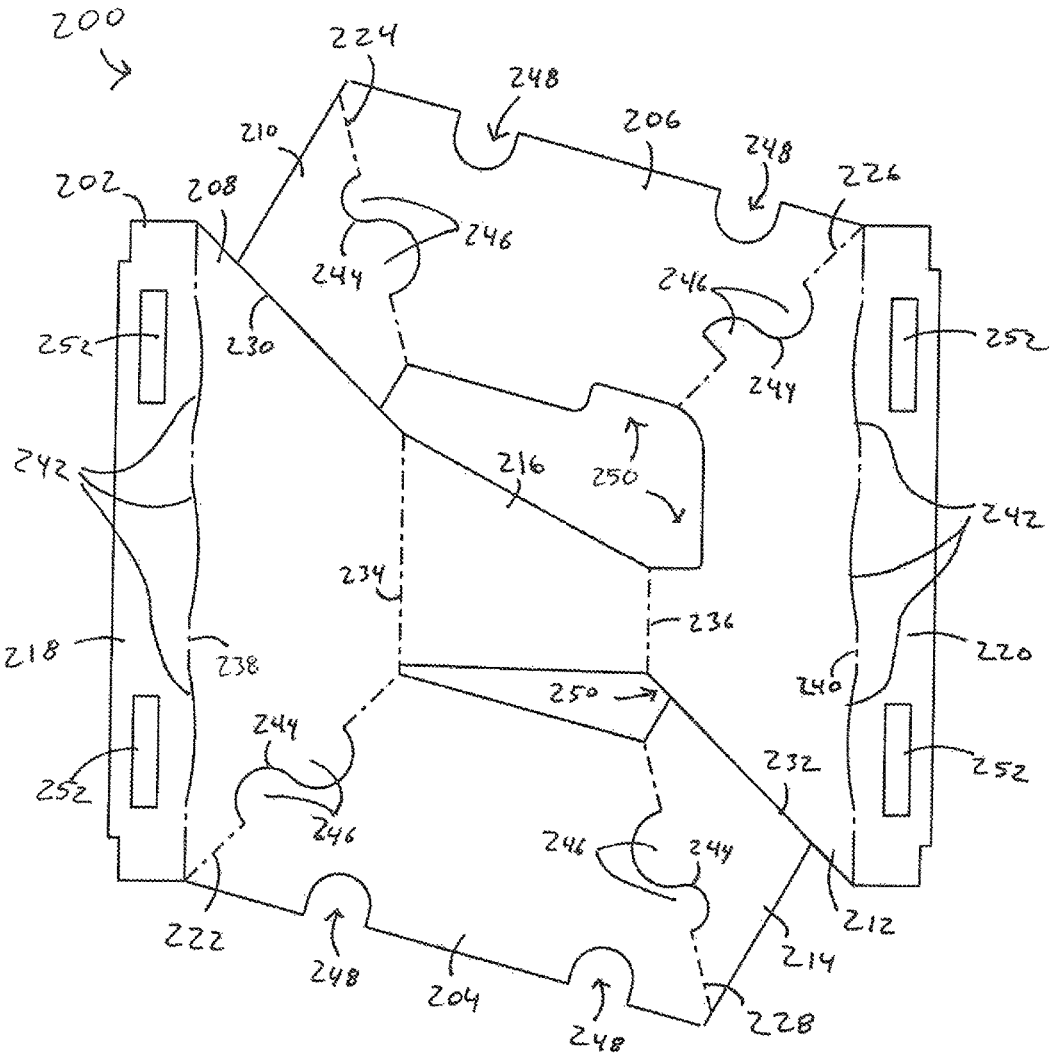
FIG. 7 is a top plan view of an unfolded blank of a lower support for an appliance such as a washing machine, according to a second alternative embodiment of the present invention.
Figure 8:
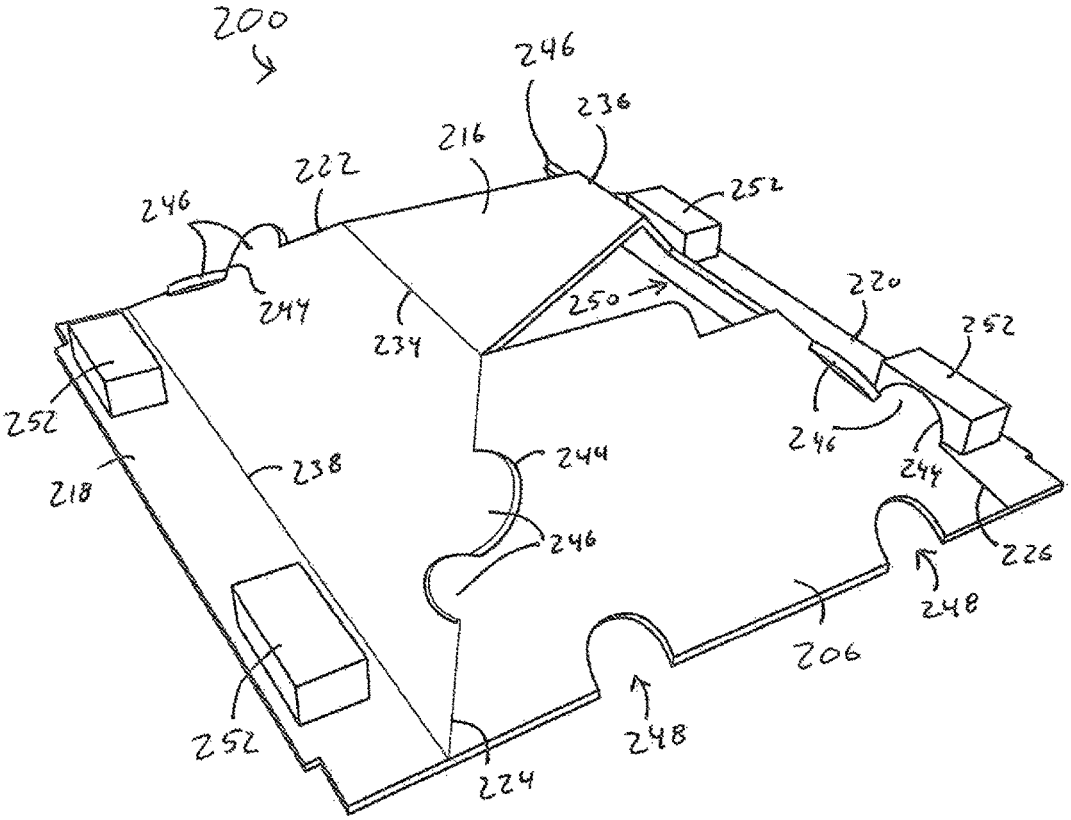
FIG. 8 is a perspective view of the folded lower support of FIG. 7 showing the lower support in an erected configuration.

Turning now to FIGS. 7 and 8 and initially FIG. 7, there is shown a base or lower support 200 according to a second alternative embodiment the present invention. The lower support 200 generally is made of a sheet or blank 202 of packaging material. As with the prior embodiments, the packaging material may consist of corrugated board having a fluted corrugated core located between two sheets of kraft paper or linerboard, cardboard, or any similar material suitable for use in shipping container construction. The blank 202 may be stamped or cut from a sheet of the packaging material while in a substantially flat orientation, and subsequently folded to form the erected lower support 200 illustrated in FIG. 8. The outer surface of the lower support 200 may be printed to display information such as contents details, shipping information, disassembly instructions, orientation indicia and the like. The outer surface of the lower support 200 may also contain advertising information or ornamental elements.

FIG. 7 illustrates the blank 202, formed of a single piece of packaging material in a flat orientation. The blank 202 includes primarily a front panel 204, a rear panel 206, an outer first side panel 208, an inner first side panel 210, an outer second side panel 212, an inner second side panel 214, a top 216, a first side flange 218, and a second side flange 220. As illustrated in FIG. 7, the blank 202, when in a flat orientation roughly approximates an irregular hexagonal shape with the front, rear and side panels 204, 206, 208, 210, 212, 214, 216 roughly approximating irregular trapezoids.

The front panel 204 is hingedly attached to the outer first side panel 208 about a score line 222, while the inner first side panel 210 is hingedly attached to the rear panel 206 about a score line 224. Similarly, on the opposing side of the blank 202, the rear panel 206 is hingedly attached to the outer second side panel 212 at a score line 226, while the inner second side panel 214 is hingedly attached to the front panel 206 at a score line 228. The score lines 222 and 228 are located on opposing ends of the from panel 204, and the score lines 224 and 226 are located on opposing ends of the rear panel 206.

The outer first side panel 208 is located adjacent the inner first side panel 210, and separated therefrom by cut line 230. On the opposing end of the blank 202, the outer second side panel 212 is also located adjacent the inner second side panel 214, and separated therefrom by cut line 232. In this orientation the first side panels 208, 210 are free to rotate about their respective score lines 222, 224, while the second side panels 212, 214 are free to rotate about their respective score lines 226, 228.

Still referring to FIG. 7, the top panel 216 is located between the outer first and second side panels 208, 212. Top panel 116 is hingedly affixed to the outer first side panel 208 at a score line 234. Score line 234 is extends between the score line 222 and score line 230, and is configured to be located on the upper edge of the lower support 200, when the lower support 200 is erected in a folded configuration. The opposing side of the top panel 116 is attached to the outer second side panel 212 at a score line 236. Score line 236 extends between the score line 226 and 1cut line 232, and is also configured to be located near the upper edge of the lower support 200, when the lower support 200 is erected.

As illustrated in FIG. 7, first and second side flanges 218, 220 are affixed to the outer first and second side panels 208, 212, respectively, along the edges opposite the top panel 216. That is to say that the first side flange 218 is hingedly affixed to the outer first side panel 208 at a score line 238, which is configured to be located on the lower edge of the lower support 200, when the lower support 200 is erected. Similarly, the second side flange 220 is hingedly affixed to the outer second side panel 212 at a score line 240, which is also configured to be located on the lower edge of the lower support 200, when the lower support 200 is erected. In one embodiment, as illustrated in FIG. 7, the score lines 238, 240 may be interrupted by one or more perforation or cut lines 242 through the blank 202 of packaging material. These cut lines 242 may be linear or arched into the area of the outer first and second side panels 208, 212, as shown, and may provide increased flange surface area for supporting the washing machine and/or structural reinforcement to the outer first and second side panels 208, 212.

Similarly, the score lines 222, 224, 226, 228, that separate the side panels 208, 210, 212, 214 from the front and tear panels 204, 206 respectively may also be interrupted by one or more perforation or cut lines 244. As illustrated in FIG. 7, the cut lines 244 may have a curve, such as a sigmoidal or S-shaped curve that extends beyond the respective score line 222, 224, 226, 228, and into the surrounding panel 204, 206, 208, 210, 212, 214. Accordingly, when the lower support 200 is erected in a folded configuration and the panels 204, 206, 208, 210, 212, 214 are folded about their respective score lines 222, 224, 226, 228, the cut lines 244 will result in the formation of one or more outwardly projecting tabs 246. In the illustrated embodiment, the two outwardly projecting tabs 246 of each score line 222, 224, 226, 228, engage one another when the lower support 100 is erected to provide structural reinforcement. However, other shapes of the cut lines 244 and tabs 246 are considered well within the scope of the invention.

Additionally, the front and rear panels 204, 206 may include one or more voids as is illustrated in FIG. 7. Specifically, the panels 204, 206 may include one or more lower voids 248 and/or one or more upper voids 250. These lower voids 248 may provide structural reinforcement to the panels 204, 206, allowing the lower support 200 to integrate with the remaining portions of the shipping container, allow the lower support 200 to engage other shipping containers when stacked, and/or allow the lower support to be maneuvered by either a person or a mechanical lift.

Furthermore, as illustrated in FIG. 7, the upper voids 250 are located along the upper edges of the outer and inner second side panels 212, 214 and the rear panel 206. The upper voids 250 are configured to accommodate and engage the motor or other components of the washing machine, once the lower support 200 has been erected. Accordingly, the number, shape and orientation of the upper voids 250 may vary depending on the configuration of the motor or other components of the washing machine or appliance. As specifically illustrated in FIG. 5, the upper void 250 extends across a portion of the upper edge of the outer and inner second side panels 212, 214 and rear panel 206. The corresponding upper void 250 of both the inner second side panel 214 and rear panel 206 are reduced to a corner near cut line 232 and score line 226, respectively.

Turning now to FIG. 8, the blank 202 will be described in a folded and erected configuration to form lower support 200. The blank 202 is folded around the score lines 222, 224, 226, 228, until the inner and outer first side panels 208, 210 and inner and outer second side panels 212, 214 overlap such that their respective upper voids 250 also overlap. The blank 202 is then retained in this folded configuration by means of applying adhesive between the inner and outer first side panels 208, 210 and inner and outer second side panels 212, 224. Alternatively, the first side panels 208, 210 and second side panels 212, 214 may be retained in their folded configuration by means of fasteners, adhesive tape or any other known means of fixation. The side flanges 218, 220 are then folded outwardly, approximately 90 degrees around score lines 238, 240, respectively to form a base of support on which the lower support 200 rests. Once the side flanges 218, 220 have been folded, support blocks 252 may be placed or fixed to the upper surface of the side flanges, as illustrated in FIGS. 7 and 8. The support blocks 252 are configured to receive the housing of the washing machine or other appliance, either directly or indirectly thereon, and may be formed of a resilient or shock absorbent material such as foam. The upper surface of the blocks 252 may be flat as illustrated in FIG. 8, or they may be contoured to engage a portion of the washing machine therein.

The lower support 200 is then positioned to support the internal component(s) of an appliance such as a washing machine in the same manner as shown in FIG. 4 and described previously.

Although specific embodiments are illustrated and discussed above, it is understood that the size and shape of the lower support 10, 100, 200 may vary greatly to accommodate the size and shape of the washing machine or other device requiring a lower support 10, 100, 200. While the figures have illustrated lower support 10, 100, 200 configured to support the internal components of a conventional top-load washing machine, larger or smaller lower supports 10, 100, 200 are considered well within the scope of this invention. In this regard, lower supports 10, 100, 200 for other home appliances, furniture, or electronics are within the scope of this invention. Similarly, any number, location, variation or combination in the multiple styles of panels and voids described herein is considered within the scope of the present invention.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A base for receiving an appliance thereon, the base comprising:

a first pair of sides comprising a generally trapezoidal first side and an opposing generally trapezoidal second side, the first and second skies each having a top edge and a bottom edge;

a second pair of sides joined to the first pair of sides, the second pair of sides comprising a generally trapezoidal third side and an opposing generally trapezoidal fourth side, the third and fourth sides each having a top edge and a bottom edge;

a pair of bottom flanges, each of which extends outwardly from the bottom edge of the sides of one of the pairs of sides; and a top panel joined to and extending between the top edges of the sides of one of the pairs of sides, wherein the top panel extends across an interior cavity defined by the first and second pairs of sides, and wherein the top panel defines a first edge that is connected via a hinge connection to the top edge of one of the sides and a second edge that is connected via a breakable connection with the top edge of an opposite one of the sides, wherein the top panel is separable from the opposite one of the skies via the breakable connection and is pivotable downwardly via the hinge connection into the interior cavity while remaining connected to the top edge of the side via the hinge connection, wherein movement of the top panel into the interior cavity defines an opening for receiving a portion of the appliance within the interior cavity.

2. The base of claim 1, wherein each of the first and second sides comprises an outer panel and an inner panel.

3. The base of claim 2, wherein the outer panel of the first side is affixed to the inner panel of the first side and the outer panel of the second side is affixed to the inner panel of the second side.

4. The base of claim 3, wherein the outer panels are adhesively affixed to the inner panels.

5. The base of claim 1, wherein each flange includes an upper surface configured to receive a plurality of support blocks thereon.

6. The base of claim 1, further comprising a first score line at the bottom edge of the side from which a first one of the flanges extends and a second score line at the bottom edge of the side from which a second one of the flanges extends, wherein the first and second score lines are interrupted by a plurality of nonlinear cut lines.

7. The base of claim 1, wherein the interior cavity is further defined by one or more irregular edges, the one or more irregular edges being formed by the top edges of the sides other than the side that is connected at the hinge connection to the top panel.

8. The base of claim 7, wherein the irregular edge is configured to engage a portion of the appliance when the portion of the appliance is received in the interior cavity.

9. The base of claim 8, wherein the base inhibits movement of the portion of the appliance when the portion of the appliance is received in the interior cavity.

10. The base of claim 1, wherein an end of the top panel opposite the hinge connection is selectively disengaged from one of the sides while the top panel remains connected via the hinge connection to the opposite one of the sides.

11. The base of claim 1, wherein the top panel is configured to be engaged by a lower surface of the appliance when the portion of the appliance is received in the interior cavity.

12. The base of claim 1, wherein one or more adjacent sides are divided by a score line, the score line being interrupted by a nonlinear cut line that extends into the surface of the one or more adjacent sides divided by the score line.

13. The base of claim 12, wherein the base has one or more outwardly projecting tabs defined by the nonlinear cut line when the adjacent sides are folded about the score line.

14. The base of claim 1, further comprising a plurality of voids at a lower edge of one or more of the sides.

15. A method of assembling a base and positioning an appliance component therein, comprising the steps of:

folding a sheet comprising first, second, third and fourth sides and a top panel into an erected configuration, wherein the top panel extends between and interconnects a pair of opposing ones of the first, second, third and fourth sides;

affixing an outer panel of the first side to an inner panel of the first side while the outer and inner panels of the first side are overlapping;

affixing an outer panel of the second side to an inner panel of the second side while the outer and inner panels of the second side are overlapping;

wherein the first, second, third and fourth sides cooperate to form an internal cavity, and wherein the top panel overlies the internal cavity; and advancing the appliance component toward the base, wherein the appliance component engages the top panel and advancement of the appliance component into the internal cavity causes the top panel to separate from one of the sides and to pivot about a top edge of the opposite one of the sides with which the top panel remains engaged, wherein continued advancement of the appliance component positions the appliance component within the internal cavity.

16. The method of claim 15 further comprising the steps of:

tearing a perforation between the top panel and one of the sides to form a disengaged top panel; and rotating the disengaged top panel about a hinge line while the disengaged top panel is retained to a side opposite the perforation.

17. The method of claim 15 further comprising the step of:

affixing a plurality of support blocks on an upper surface of the discontinuous flange, wherein the support blocks are configured to engage the appliance when the component of the appliance is inserted into the internal cavity.

* * * * *